United States Patent [19]

Kruger

[11] Patent Number: 4,865,213

[45] Date of Patent: Sep. 12, 1989

[54] COMPOSITE PANEL, WALL ASSEMBLY AND COMPONENTS THEREFOR

[76] Inventor: Paul J. Kruger, 5504 - 141st Street, Edmonton, Alberta, Canada, T6H 4A2

[21] Appl. No.: 167,359

[22] Filed: Mar. 14, 1988

[51] Int. Cl.[4] ..... B65D 6/02

[52] U.S. Cl. ..... 220/76; 52/169.7; 52/280; 52/281; 52/288; 220/5 A; 220/18; 220/83

[58] Field of Search ..... 220/22, 23.4, 76, 83, 220/18, 5 A; 52/280, 281, 288, 169.7, 578

[56] References Cited

U.S. PATENT DOCUMENTS

| | | | |
|---|---|---|---|
| 2,861,277 | 11/1958 | Hermann | 220/5 A |
| 3,409,916 | 11/1968 | Billig et al. | 220/5 A X |
| 3,819,079 | 6/1974 | Levens | 220/5 A |
| 3,951,294 | 4/1976 | Wilson | 220/76 X |
| 4,048,773 | 9/1977 | Laven | 52/169.7 |
| 4,126,976 | 11/1977 | Crowley | 52/169.7 X |
| 4,185,430 | 1/1980 | Gartung | 52/288 X |
| 4,291,803 | 9/1981 | Perales | 220/23.4 X |
| 4,635,304 | 1/1987 | Zikmanis et al. | 52/169.7 X |
| 4,748,783 | 6/1988 | Labelle | 52/578 X |

FOREIGN PATENT DOCUMENTS

| | | | |
|---|---|---|---|
| 9009 | 3/1980 | European Pat. Off. | 52/280 |

*Primary Examiner*—Harvey C. Hornsby
*Assistant Examiner*—Stephen F. Gerrity
*Attorney, Agent, or Firm*—Becker & Becker, Inc.

[57] ABSTRACT

A container for confining hydrocarbon spills and the like is comprised of a plurality of portable concrete wall panels which can be hingedly connected to one another by connector members.

7 Claims, 3 Drawing Sheets

COMPOSITE PANEL, WALL ASSEMBLY AND COMPONENTS THEREFOR

BACKGROUND OF THE INVENTION (1) Field of the Invention

My present invention is concerned with improvements in wall assemblies made of a plurality of composite wall panels, such as concrete wall panels, and components and connectors for such assemblies. My invention is also concerned with a method of making such composite wall panels by molding concrete to form a concrete panel.

My invention is particularly applicable for the provision of upstanding walls around oil tanks and the like hydrocarbon storage facilities, thereby to form part of a containment structure which can satisfy safety regulations for spills around such storage facilities.

(2) Prior Art

Various structures have been described in the prior art to form dikes and the like retaining means at storage facilities for hydrocarbon liquids and the like.

Thus, U.S. Pat. No. 3,940,940 of Mar. 2, 1976 to Joseph Edward Barrett is concerned with a method of protecting ground surfaces from spilled petroleum products, which method comprises covering the surface with a laminate including a polymeric membrane and a layer of fibre reinforced unsaturated polyester resin applied on top of the membrane. The membrane is impervious to the resin and sufficiently flexible to accommodate the ground contours. Barrett contemplates to provide a depression in the ground or to hollow out the storage area to make it saucer-shaped so that any spilled liquid in the area will gravitate to the centre of the hollowed region. Barrett then covers the depression with the laminate comprised of a cured glass fibre reinforced resin sheet on top of the membrane, to preclude penetration of hydrocarbon liquids into the soil. Accordingly, Barrett requires the digging of depressions in the ground, and such moving of earth is also practiced in building raised earth dikes around hydrocarbon storage facilities.

Thus, the U.S. Pat. No. 3,930,590 of Harold K. Ebbrell, issued Jan. 6, 1976, a storage facility for liquefied gas is disclosed in which a storage vessel is surrounded by a wall which forms a collecting space around the vessel. The surfaces of the ground of the collecting space and/or the wall comprise a layer of a heat insulating material, whereby any liquefied gas collected in the collecting space evaporates more slowly, thereby reducing the hazard from gas vaporized in the collecting space. reducing the hazard from gas vaporized in the collecting space.

U.S. Pat. No. 3,791,164 of Royce Jay Laverman, issued Feb. 12, 1974, is typical of the hitherto known practice of erecting fixed walls, and describes a storage tank facility for a liquefied gas having an enclosed tank, a vertical dike wall around and spaced from the tank side wall, thereby defining a well space between the dike wall and the tank side wall. The dike wall includes a plurality of vertically disposed conduits which communicate with the bottom of the well space, for venting cold liquefied gas vapors through such vertical conduits to the atmosphere.

U.S. Pat. No. 3,047,184 of J. C. van Bergen et al., issued July 31, 1962, discloses a wall surrounding a tank, which wall is built up of bricks, and the outside of the wall is surrounded by a wall of earth.

There has remained, however, the need to provide more economical yet effective protection around hydrocarbon-liquid storage facilities.

There is also nowadays the need to provide temporary or portable walls or panels for spill emergencies for in-situ type heavy oil recovery operations where permanent dike structures may be associated with correspondingly higher operational expense in first shaping and subsequently levelling earth structures or bricked types of retainment walls. More particularly, in closely-spaced well patterns, the creation and removal of dikes is a considerable economical concern with the operators.

SUMMARY OF THE INVENTION

In accordance with one aspect of my invention there is a panel, said panel being obtained by molding a respective concrete composition; and said panel having at least one metal hinge element integrally secured at a respective peripheral edge, with said metal hinge element being secured at said panel to project sufficiently therefrom so as to present a first hinge element.

Several of the panels can be connected in a coral-type wall assembly in a variety of configurations, e.g, rectangular, square, hexagonal and other like multi-sided layouts when viewed in plan view are feasible.

In accordance with another aspect of my invention there is provided, for use in a wall assembly, a portable composite panel comprising: a concrete panel body, said concrete panel body being obtained by molding a respective concrete composition; and a frame assembly for reinforcing the peripheral edges of said concrete panel body; said frame assembly including at least one metal member for provision of a first hinge element for connecting a plurality of said panels in a corral-type wall assembly.

The panel can include concrete secondary reinforcing fibers or wire mesh in the concrete panel body.

The panel can include metal re-inforcing prestressing elements secured at the frame assembly.

The panel can also include rod-like anchor elements secured by gun-welding at the frame.

The frame assembly can include a first longitudinal, top, member, a second longitudinal bottom member, with the bottom member being disposed substantially parallel with respect to said top member in said frame, a first longitudinal side member secured with its one end at said top member and with its other secured with its one end at said top member and with its other end at said bottom member, and a second longitudinal side member disposed substantially parallel with respect to said first longitudinal side member, said second longitudinal side member being secured with its one end at said top member and with its other end at said bottom member, and with said first and second side members providing respectively first means for hingedly joining a plurality of panels to one another.

The mentioned panels can be arranged in a wall assembly using connector means providing second means for hingedly joining a plurality of the panels. The connector means allow hinge type movement of connected wall panels with respect to one another.

The metal member can be a cylindrical hollow pipe section or end for provision of socket-type hinge portions.

The connector means can comprise a base and at least two projecting formations extending from the base, and each formation being adapted to be inserted in a respective socket-type hinge portion of the respective panel.

In accordance with another aspect of my invention there is provided a container for confinement of oil spills and similar spills, which container is comprised of a plurality of panels, each panel including a concrete panel body, obtained by molding a respective concrete composition; and a frame assembly for reinforcing the peripheral edges of said concrete panel body. The frame assembly can include at least one first means for hingedly joining a plurality of panels to one another in a corral-type wall assembly. There are also contemplated connector means providing second means for hingedly joining a plurality of panels, with the connector means allowing hinge type movement of connected panels with respect to one another.

The container further has a bottom, such as a sheet or tarp which is sealingly secured at the foot end of the wall assembly to confine spilled oil or other respective fluid within the walls of the container.

At abutting panels in a respective side wall of the container there may be provided an exterior brace panel or wing-wall comprised of a concrete panel body, obtained by molding a respective concrete composition; and at least one metal member integrally secured at the concrete panel body, with the metal member providing a hinge element for connecting the exterior brace at the adjacent panels. The mentioned connector means is then provided with three matching tines or formations.

In accordance with another aspect of my invention there is provided a method of making a wall panel comprised of a metal hinge member and a concrete panel body, said method comprising the steps of: providing at least one metal hinge member; arranging said hinge member on a mold table; pouring a respective concrete composition to substantially fill the mold; solidifying the concrete to form a concrete panel body integrally with said hinge member; and removing the resultant finished panel from the mold table.

The hinge member can be part of a peripheral frame assembly, and prestressing can be achieved by disposing prestressing elements continuously through the frame assembly.

When several panels are produced in one molding operation, the prestressing elements between adjacent frame assemblies are severed, for example, by torch cutting.

Included in the objects of my invention are:

To provide a portable wall panel for use in a wall assembly.

To provide a panel system which allows a variety of layouts and wall arrangements.

To provide panels which are easily connected to form a continuous wall at potential spill sites.

To provide a method of producing panels in an economical manner.

DESCRIPTION OF THE DRAWING

Other and further objects and advantages of my invention will become more readily apparent from the following detailed description taken in conjunction with the accompanying drawings in which.

SPECIFIC DESCRIPTION

Figure 1:
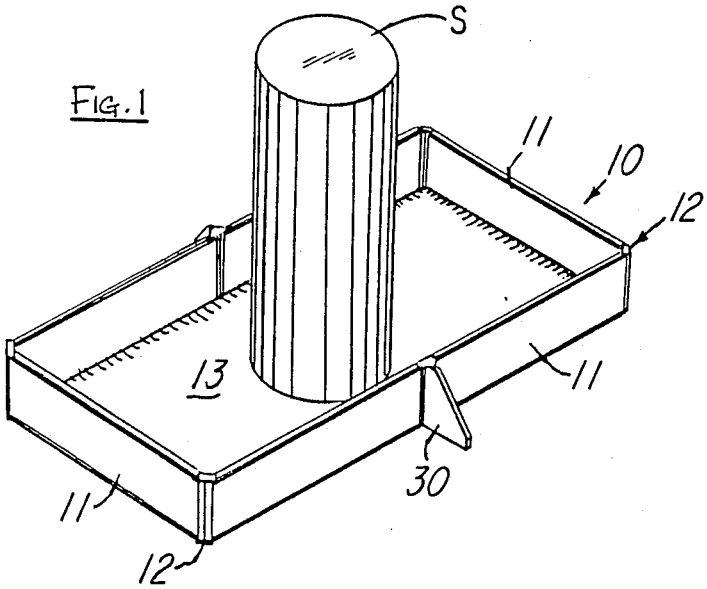
FIG. 1 is a perspective view of a storage container which is surrounded by a wall assembly including several portable wall panels.

With reference to FIG. 1, my invention is particularly suited to form a hydrocarbon-spill confinement container 10. Around a storage container or tank S. The container 10 is comprised of a plurality of portable concrete wall panels or units 11 which can be hingedly connected to one another by a hinge system 12, as will be described further below. The bottom of the container 10 can be a PVC sheet 13, and the like tarp.

Figure 2:
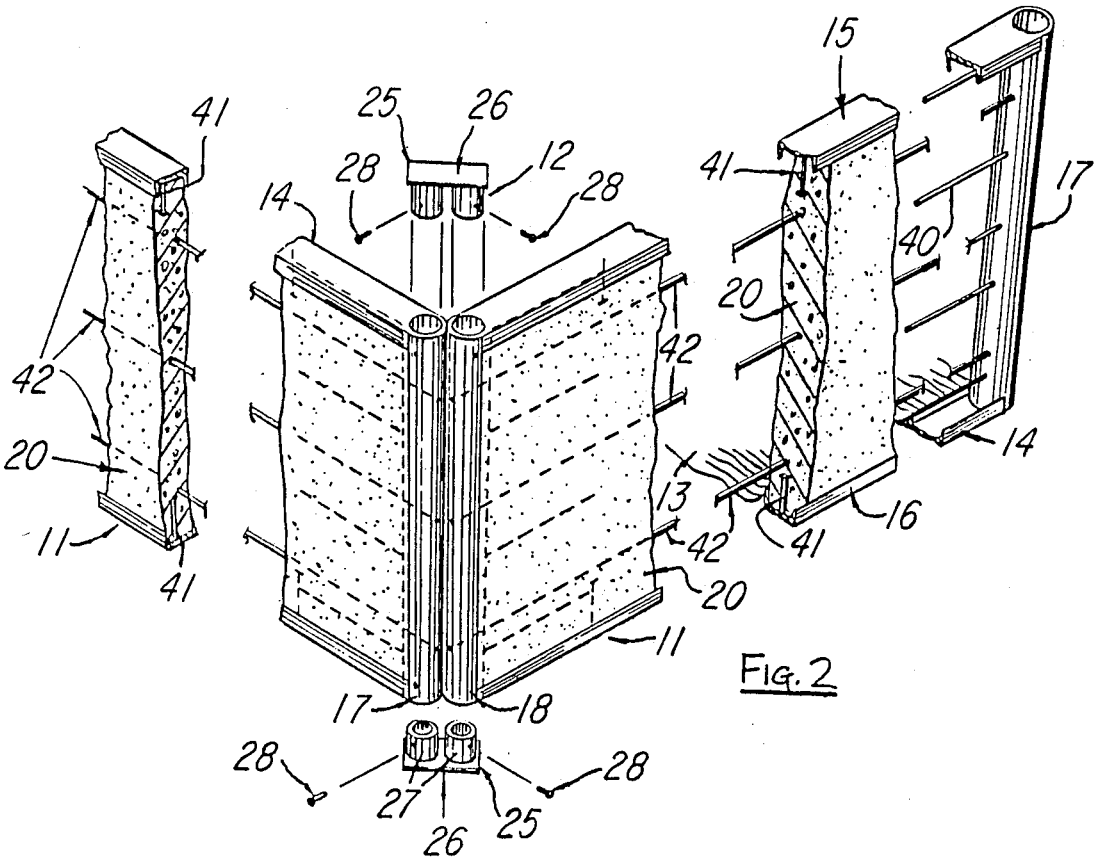
FIG. 2 is a perspective view of two cornering wall panels.
Figure 5:
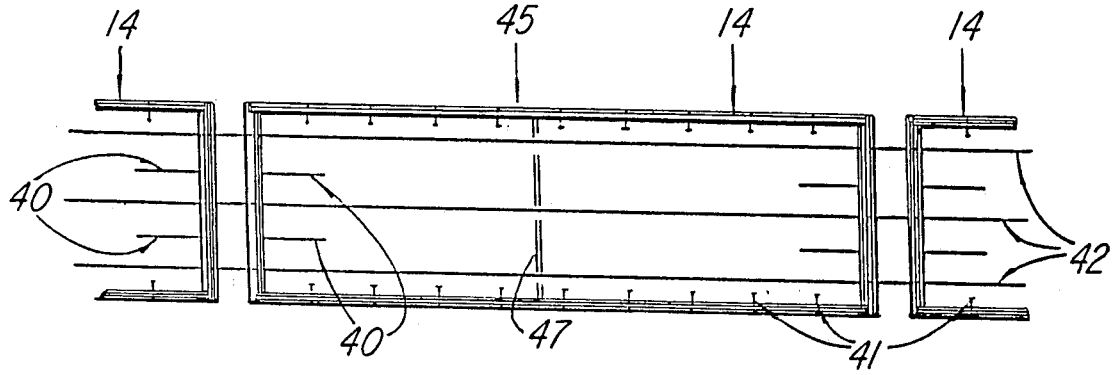
FIG. 5 is a schematic top plan view of a mold table for molding a plurality of concrete wall panels.

With reference to FIGS. 2 and 5, a composite panel 11 is comprised of a frame structure 14 including a first longitudinal or top member 15, and a second longitudinal or bottom member 16. The bottom member 16 extends substantially parallel with respect to the top member 15 in the frame structure 14.

A first longitudinal side member 17 is secured with its one end at the top member 15 and with its other end it is secured at the bottom member 16. Similarly, a second longitudinal side member 18 is disposed substantially parallel with respect to the first longitudinal side member 17, and the second longitudinal side member 18 is secured with its one end at the top member 15 and with its other end at the bottom member 16. Securement of the mentioned members forming a frame structure 14 can be by welding. The side members 17 and 18 are pipe sections which are open at the upper and lower ends.

To provide the panel 11, a concrete filler or core 20, also referred to as concrete panel body, is provided over the full height and length of the frame structure 14 and secured integrally therewith during the respective molding, as will be described further below. Thus, the concrete core 20 and the frame structure 14 define a portable wall panel 11.

Several wall panels or units 11 can be hingedly connected to one another by means of the mentioned hinge system 12.

Figure 3:
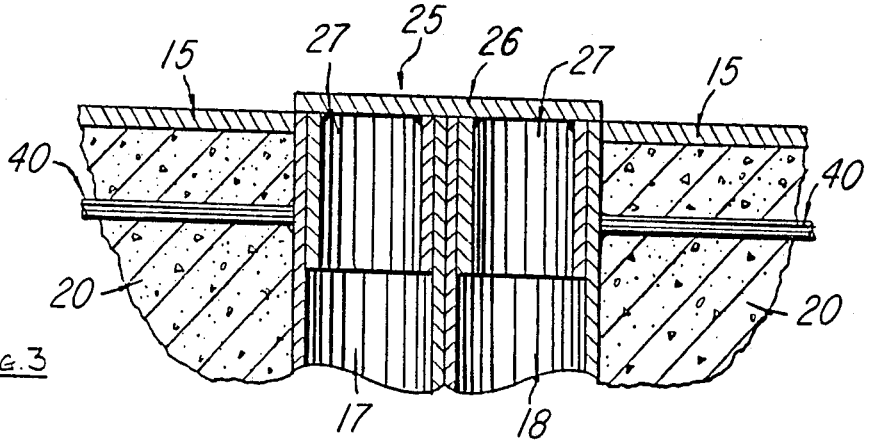
FIG. 3 is a cross-sectional elevation showing two adjacent wall panel units in abutting relationship and with a connector mounted in place.

With particular reference to FIGS. 2 and 3, in the case of two panels arranged in straight-line abutting relationship, a hinge system or assembly 12 is typically comprised, firstly, of the side member or pipe section 17 of one wall panel 11 and the side member or pipe section 18 of another wall panel 11. Two connectors 25 complete the hinge system 12. Each connector 25 is comprised of a planar base member 26 and two projecting formations or tines 27 which can also be cylindrical hollow pipe sections having an outer diameter of a size allowing easy insertion of a respective tine 27 into the correspondingly dimensioned opening of the side member 17 and the side member 18. Securement of the connectors 25 can be by set screws 28.

The hinge system 12 will allow arrangement of wall panels 11 in a variety of angular configurations when viewed in plan view, and can enhance the structural stability of the container 10. Thus, while a rectangular container 10 has been shown in the drawings in which the wall panels 11 are arranged to respectively embrace angles of 90° and 180°, the container 10 can be hexagonal when viewed in plan, or made in such other configurations in which the individual panels are arranged other than in the shown 90° and 180° attitudes. Such arrangement can be quickly and efficiently effected by merely releasing the set screws 28.

Thus, the container 10 is comprised of a plurality of wall panels 11 in which the exterior frame 14 has side members (17 and 18) which provide first hinge means. The connector means 25 provide second means for hingedly joining a plurality of panel units, one at the top and one at the bottom of the abutting side members 17 and 18.

Figure 4:
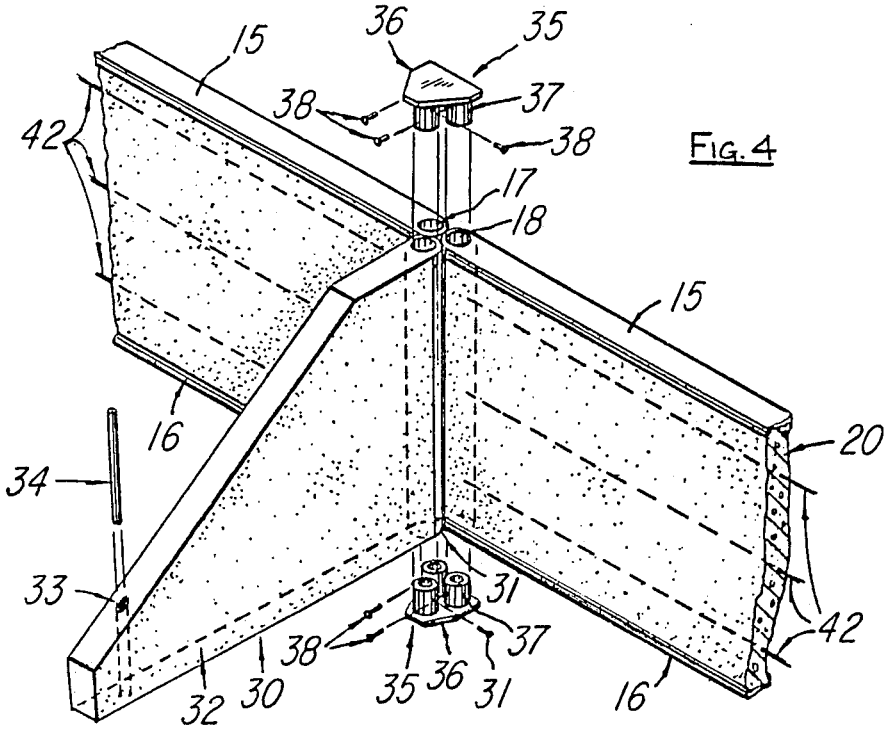
FIG. 4 is an exploded perspective view showing the connection of two abutting panels and one brace panel prior to assembly with the connector members.

FIG. 4 shows in grater detail an assembly of two panels 11 in linear abutting relationship and a brace panel or wing wall 30. The brace panel 30 is comprised of a pipe section 31 at which is integrally molded a triangular concrete panel 32. The brace panel can be secured to the ground by a post 34 which can be introduced in a pipe 33 extending perpendicularly in the concrete panel 32. Connection of the panels, two panels 11 and one brace panel 30, is by way of connector members 35. Each connector 35 has a base 36 and three projecting pipe sections 37 which can be introduced into the receiving openings at the top and bottom of the panels. Further securement can be by means of set screws 38.

Molding of the panels 11 is shown diagrammatically in FIG. 5 of the drawing figures. Thus, several frame structures 14, each comprised of top member 15, bottom member 16 and the connecting side members 17 and 18, are provided with the components being joined by welding. The side members 17 and 18 are provided with four anchor rods 40, for example NELSON studs, which are secured by gun-welding, to ultimately extend laterally into the concrete core 20. The top and bottom members 15 and 16 are each provided with short anchors 41 which ultimately extend vertically into the concrete core 20 upon molding thereof.

The panel 11 s prestressed by stressing cables 42 which extend longitudinally in the finished panel 11 from the first side member 17 to the second side member 18.

As indicated in FIG. 5, the molding table 45 accommodates several frame structures 14. The stressing cables 42 extend through holes in the side members 17 and 18 of each frame structure 14, and the cables 42 are connected at each end of the molding table 45 to respective stressing equipment (not shown).

When concrete has been poured and solidified to form the core 20 of each panel 11, the stressing cables 42 are severed, for example by torch cutting, near the respective side members 17 and 18. The finished panels 11 can then be removed from the molding table 45 and stored for shipping.

Manufacture of a brace panel 30 is done in an analogous manner with provision of a temporary frame to mold the concrete panel 32 to the pipe section 31. The concrete panel 32 is reinforced by wire mesh or reinforcing fibres and includes in the sloping side the pipe 33 in which can be introduced the post 34 to anchor the wing wall 30 in the ground (FIG. 4).

Figure 6:
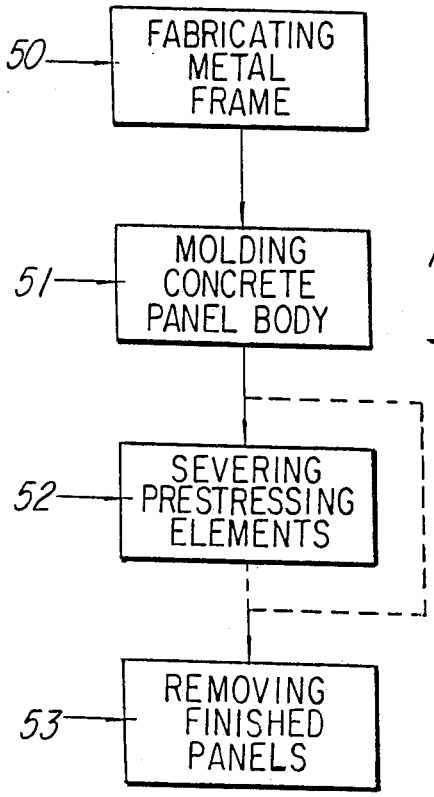
FIG. 6 is a flow sheet illustrating method steps of my invention.

With reference to FIG. 6 of the drawing figures, the main steps of my method, accordingly, include step 50, fabricating of the metal frame structure 14; next, molding (51) of the concrete panel 20, and in step 52, the stressing cables 42 are severed to allow removal of the finished panels, step 53.

Figure 7:
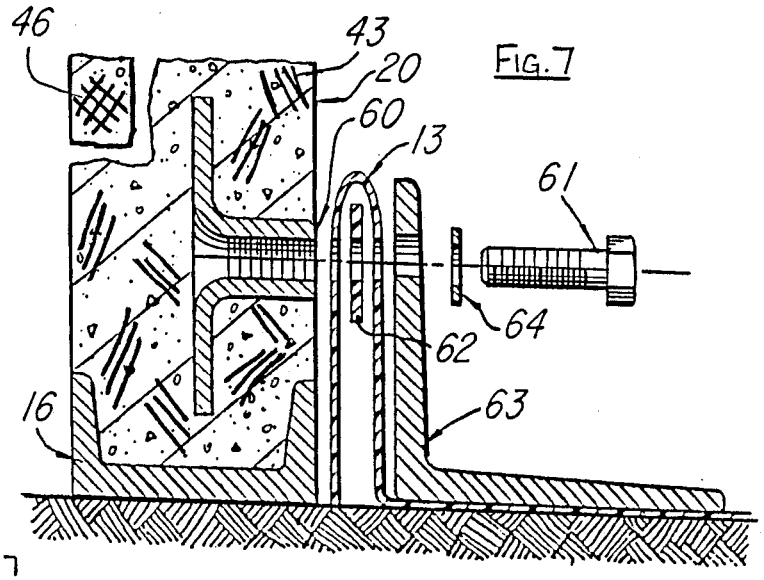
FIG. 7 is a cross section at the foot end of a panel showing the fastening of the bottom forming sheet.

In accordance with a particular feature of my invention the concrete core 20 is further reinforced by a secondary reinforcing, such as reinforcing fibers 43 (FIG. 7) mixed with the concrete composition which forms the concreted panels 20 and 30, or wire mesh 46 (FIG. 7). Such secondary reinforcing fibers in the concrete further enhance the adhesion of the concrete to the metal frame structure 14. Reinforcing bar elements such as indicated by reference numeral 47 (FIG. 5) may also be provided at the frame structure 14.

The detail of FIG. 7 shows the foot end of a panel 11 with the channel formation of the bottom member 16 embracing the concrete panel 20. Inserts 60 are molded in place during the molding step 51, and the inserts 60 provide a threaded opening for a screw 61. The bottom 13 of the container 10, as mentioned, can be a PVC sheet or similar heavy-duty tarp which is impervious to the fluid stored in the tank S. The sheet or bottom 13 is folded once and interposed between the overlapping ends is a longitudinal bar or washer element 62 of a plastic material to serve as further seal on securing the screws 61. To hold the sheet or bottom 13 in place an angle profile member such as 63 can be used using a washer 64 at each screw 61.

Additional sealing may be provided by caulking at the bottom 13 and between the side members 17 and 18. If desired, the panels 11 can be connected by welding the side members 17 and 18.

While a female-type socket has been shown at the side members 17 and 18, and male-type connectors 25 and 35, it is also within the scope of this invention to provide a male-type hinge portion at the side members 17 and 18, respectively. The connectors 25 and 36 have then correspondingly dimensioned hollow tines 26 and 36, respectively.

It will be understood that the embodiments illustrated in the aforesaid are primarily used for describing the present invention, but not as limiting the present invention. Any structure or apparatus made with or without minor modifications but not deviating from the spirit, concept and features of the present invention is deemed as being included in the scope of the claims of my invention.

I claim:

1. For use in a wall assembly to confine liquid spills, a substantially co-planar portable composite panel of uniform thickness comprising:

a prestressed concrete panel body with peripheral edges, said concrete panel body being obtained by molding a respective concrete composition; and a metal frame assembly for reinforcing said peripheral edges of said concrete panel body; said frame assembly including:

a first longitudinal, top, member;

a second longitudinal, bottom, member, said bottom member being disposed substantially parallel with respect to said top member in said frame;

a first longitudinal hollow side member, said first longitudinal side member having a first end and a second end, said first end secured at said top member and said second end secured at said bottom member; and a second longitudinal hollow side member disposed substantially parallel with respect to said first longitudinal side member, said second longitudinal side member having a first end and a second end, said first end of said second longitudinal side member is secured at said top member and said second end of said second longitudinal side member is secured at said bottom member; said first and second side members providing respectively first means for hingedly joining a plurality of said panels to one another in a corral-type wall assembly.

2. The panel according to claim 11 which includes at least one concrete secondary reinforcing from the group including reinforcing fibers, wire mesh and reinforcing bar, in said concrete panel body.

3. The panel according to claim 11 which includes rod-like anchor elements secured by gun-welding at said frame.

4. The panel according to claim 11, wherein said hollow side member is a cylindrical pipe section for provision of socket-type hinge portions.

5. A container for confinement of liquid spills and the like, comprising in combination:

(a) a plurality of portable substantially co-planar panels, of uniform thickness each panel including a prestressed concrete panel body, said concrete panel body being obtained by molding a respective concrete composition; and a metal frame assembly for reinforcing the peripheral edges of said concrete panel body; each frame assembly including:

a first longitudinal, top, member;

a second longitudinal, bottom member, said bottom member being disposed substantially parallel with respect to said top member in said frame;

a first longitudinal hollow side member, said first longitudinal side member having a first end and a second end, said first end secured at said top member and said second end secured at said bottom member; and a second longitudinal hollow side member disposed substantially parallel with respect to said first longitudinal side member, said second longitudinal side member having a first end and a second end, said first end of said second longitudinal side member is secured at said top member and said second end of said second longitudinal side member is secured at said bottom member; said first and second side members providing respectively first means for hingedly joining a plurality of said panels to one another in a corral-type wall assembly;

(b) connector means providing second means for hingedly joining a plurality of said panels; said connector means allowing hinge type movement of connected panels with respect to one another; and (c) a bottom sealingly secured at the bottom end of said wall assembly to confine spilled matter within the walls of said container.

6. The container according to claim 5, wherein the connector means comprises:

a base; and at least two projecting cylindrical formations extending from said base and each formation being adapted to be inserted in a respective socket-type hinge portion.

7. The container according to claim 12, which includes at least one exterior brace as a wing wall, said exterior brace including a concrete panel body obtained by molding a respective concrete composition, and at least one metal member integrally secured at said concrete panel body, said metal member providing a hinge element for connecting said exterior brace at a respective panel.

* * * * *

UNITED STATES PATENT AND TRADEMARK OFFICE

CERTIFICATE OF CORRECTION

PATENT NO. : 4,865,213

DATED : Sep. 12, 1989

INVENTOR(S) : PAUL J. KRUGER

It is certified that error appears in the above-identified patent and that said Letters Patent is hereby corrected as shown below:

On the cover sheet of the patent, please add the following:

[30] Foreign Application Priority Data

March 10, 1988 [CA] Canada....561,163

Signed and Sealed this

Sixth Day of February, 1990

*Attest:*

JEFFREY M. SAMUELS

*Attesting Officer*

*Acting Commissioner of Patents and Trademarks*